United States Patent [19]

Sjostrand

[11] 4,423,657

[45] Jan. 3, 1984

[54] DEVICE FOR STRINGING OF STRINGS IN PIANOS AND THE LIKE

[76] Inventor: Gunnar Sjostrand, Vattugränd 7, 591 45 Motala, Sweden

[21] Appl. No.: 308,135

[22] Filed: Oct. 2, 1981

[51] Int. Cl.[3] ..... G10C 3/10

[52] U.S. Cl. ..... 84/207

[58] Field of Search ..... 84/200–209

[56] References Cited

U.S. PATENT DOCUMENTS

| | | | |
|---|---|---|---|
| 119,760 | 10/1871 | Hastings | 84/205 |
| 180,424 | 8/1876 | Gage | 84/205 |
| 467,554 | 1/1892 | Ivers | 84/207 |
| 488,731 | 12/1892 | Fargo | 84/202 |
| 2,917,961 | 12/1959 | Madonna | 84/204 |

FOREIGN PATENT DOCUMENTS

| | | | |
|---|---|---|---|
| 1979 | of 1875 | United Kingdom | 84/207 |

*Primary Examiner*—Lawrence R. Franklin

*Attorney, Agent, or Firm*—Fisher, Christen & Sabol

[57] ABSTRACT

A device for facilitating precision tuning and stringing of pianos and the like which includes a two-armed rocker (1) one end (8) of which is attached to the string (9) and the other end (2) of which is coupled to the frame (4) of the instrument via a tuning screw (3) to provide precision tuning. Rough tuning is provided by turning the rocker (1) around its longitudinal axis in a groove (6) in another part (5) of the frame.

10 Claims, 3 Drawing Figures

DEVICE FOR STRINGING OF STRINGS IN PIANOS AND THE LIKE

BACKGROUND OF THE INVENTION

1. Field of the Invention

The present invention refers to a device for the stringing of strings in pianos, grand pianos, harpsichords, zithers and the like where a two-armed rocker is journalled in a frame and where one end of the rocker is attached to the string and the other end is affected by a tuning screw or the like.

2. Prior Art

Devices hitherto used for the stringing of pianos, grand pianos, and similar stringed instruments usually consist of a so-called tuning pin or a similar screw formed means around which the string is wound. The tuning pin is threaded in a so-called tuning block or the like whereby the friction of the thread must be high enough to resist the tractive force of the string. This force is very high in pianos and grand pianos and therefore large manual force is required to prolong or shorten the string at tuning. This gives rise to difficulties in adjusting rather small deviations in pitch, as the tuning screw has a tendency to move by leaps at the stringing. One way to solve this problem is to replace the tuning pins by so-called tuning rockers, which are two-armed rockers journalled in the frame of the instrument, one arm of the rocker being attached to the string and the other end being affected by a tuning screw or the like. One example of such a construction is shown in the U.S. Pat. No. 613,900 and a further improved tuning rocker is shown in the Swedish Patent No. 7,304,806-8. However, both these constructions require that the rough tuning and the precision tuning take place at the same working moment, which puts great demands on the piano tuner, among other things a relatively exact estimate of the length of the string must be made from the beginning.

BROAD DESCRIPTION OF THE INVENTION

An object of the present invention is therefore to provide a device for stringing in which rough tuning takes place in a simple way reminding of the conventional tuning pin principle, but which also offers a possibility of precision tuning whereby the rough tuning as well as the precision tuning imply an absolute fixing of the string stretch which gives a stable pitch of sound.

BRIEF DESCRIPTION OF THE FIGURES

The invention will now be explained in detail, reference being made to the attached drawing in which.

DETAILED DESCRIPTION OF THE INVENTION

Figure 1:
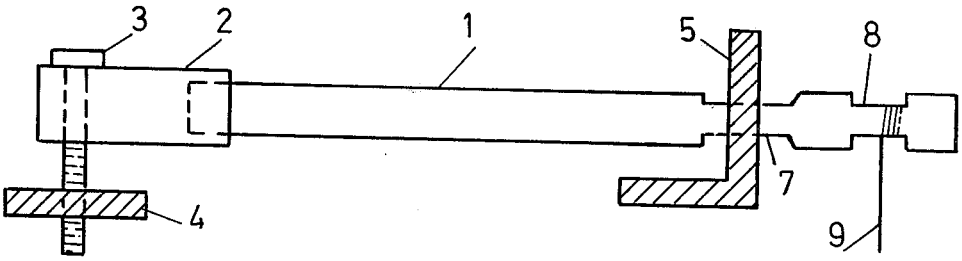
FIG. 1 schematically shows a tuning device according to the invention in the position it takes at rough tuning.
Figure 2:
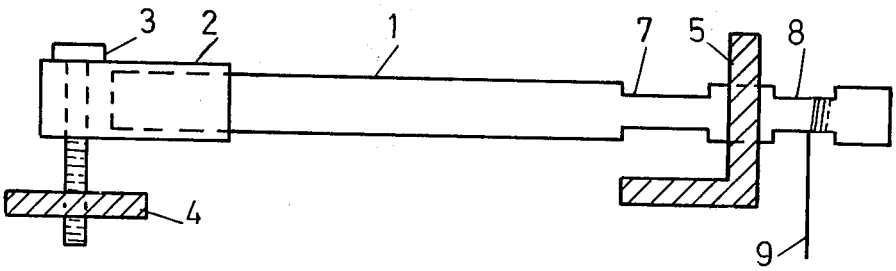
FIG. 2 shows the corresponding device in the position for precision tuning.
Figure 3:
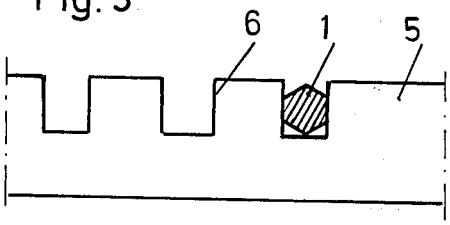
FIG. 3 shows a frame in which the rocker according to FIGS. 1 and 2 is journalled in such a way that it can be turned and locked.

In the drawing reference 1 denotes a tuning rocker journalled in a groove 6 in part 5 of a frame in a piano or the like. At one end of the rocker string 9 is attached and the other end of the rocker is coupled to another part 4 of the frame of the instrument by means of screw 3 and a casing 2 in which rocker 1 can be turned. At the embodiment according to the figure the rocker has two thin sections 7 and 8, section 7 being intended to rest in the groove 6 at rough tuning as shown in FIG. 1 while section 8 is the section around which string 9 is wound at rough tuning. Between the two sections 7 and 8 the rocker according to the drawing has a six-sided cross-section as is apparent from FIG. 3 and when the rocker is moved to the left in the figure so that this part will rest in the groove 6, the rocker is locked as regards the turning around its own longitudinal axis. This takes place after the rough tuning has been made by the turning of the rocker either manually or by means of some suitable tool. When the rocker thereafter is brought to take the position shown in FIG. 2 a precision tuning of the string stretch takes place by means of turning screw 3.

We claim:

1. A device for stringing of strings in pianos, harpsichords, zithers and the like comprising: a tuning rod having an axis, said tuning rod being adapted to tension a string; a frame member having a slot adapted for locking said tuning rod, said frame member being adapted to serve as a fulcrum for said tuning rod; said tuning rod having an end adapted to wind the string, located on one side of said slot; said tuning rod having another end, located on an opposite side of said slot; a means for applying a force to finely adjust force acting upon said tuning rod, said means for applying a force acting upon said other end, whereby a force applied by said means for applying a force acts in a direction generally parallel to said string to counteract a moment generated by tension in the string about said frame member serving as a fulcrum; said end and said other end being movable relative to each other along said axis; a locking portion of said rod being located adjacent to a coarse-adjustment portion of said rod; said locking portion being shaped to slide into said slot and prevent relative rotation between said slot and said locking portion, said coarse-adjustment portion being narrower than said locking portion in at least one dimension, being adapted to permit axial rotation of said tuning rod when said coarse-adjustment portion is engaged in said slot; a means for adjusting axial length of said tuning rod whereby said locking portion and said coarse-adjustment portion are selectively movable into said slot, to prevent axial rotation of said tuning rod while said locking portion is within said slot and to permit axial rotation when said coarse-adjustment portion is within said slot; whereby engagement of said coarse-adjustment section with said slot allows winding of the string about said end to create tension in the string, engagement of said locking section with said slot prevents unwinding of the string thereby locking in said coarse-adjustment, and said mens for applying a force may be varied finely so as to vary the torque about said frame member serving as a fulcrum so as to finely adjust tension in the string.

2. A device as claimed in claim 1, wherein said locking portion of said rod has a lateral, cross-sectional shape which is a regular polygon.

3. A device as claimed in claim 2, wherein the polygon is a hexagon.

4. A device as claimed in claim 1, wherein said means for applying a force to finely adjust said tuning rod comprises a headed fastener extending through said tuning rod into threaded engagement with a fixed support, whereby turning of the fastener results in displacement of said other end in a direction generally parallel to the string.

5. A device as claimed in claim 1, wherein said coarse-adjustment section has a lateral, cross-sectional shape which is smaller than the cross-sectional shape of said locking portion, whereby when said course-adjustment portion is located in said slot said tuning rod is axially rotatable so as to adjust the winding or unwinding of the string without significant resistance from said slot.

6. A device as claimed in claim 1, wherein said frame member has a cross-sectional shape in the form of a flange, the flange being of L-shape, said slot extends in a direction generally parallel to said string, sides of said slot being flat and spaced so as to closely fit at least two sides of said locking portion, whereby axial rotation of said locking portion is resisted by the sides of said slot so as to prevent rotation therebetween.

7. A device as claimed in claim 1, wherein said means for adjusting axial length comprises a telescoping portion of said tuning rod, whereby a force parallel to said axis and applied to said end causes axial movement of said end selectively toward or away from said other end.

8. A device as claimed in claim 1, wherein said end adapted to wind the string comprises both a narrow portion and a larger knob portion which is adapted for manual engagement.

9. A device as claimed in claim 1, wherein the moment arm created by said other end about said fixed frame is greater than the moment arm created by said end about said fixed frame, whereby a mechanical advantages exists for said means for applying a force.

10. A device as claimed in claim 1, wherein said frame member has a plurality of slots, whereby said frame member may accommodate other tuning rods.

* * * * *